US006723275B2

(12) United States Patent
Koffron et al.

(10) Patent No.: US 6,723,275 B2
(45) Date of Patent: Apr. 20, 2004

(54) VORTEX INHIBITOR WITH SACRIFICIAL ROD

(75) Inventors: Robert J. Koffron, Farmington Hills, MI (US); Ross A. Jacobs, Snowmass, CO (US)

(73) Assignee: Tetron, Inc., Farmington Hills, MI (US)

( * ) Notice: Subject to any disclaimer, the term of this patent is extended or adjusted under 35 U.S.C. 154(b) by 0 days.

(21) Appl. No.: 09/761,465

(22) Filed: Jan. 16, 2001

(65) Prior Publication Data

US 2002/0093128 A1 Jul. 18, 2002

(51) Int. Cl.[7] ..... C21B 7/12
(52) U.S. Cl. ..... 266/45; 222/590
(58) Field of Search ..... 266/230, 227, 266/286, 45, 272; 222/590, 591, 594

(56) References Cited

U.S. PATENT DOCUMENTS

| | | | | |
|---|---|---|---|---|
| 4,494,734 A | | 1/1985 | LaBate et al. | |
| 4,601,415 A | | 7/1986 | Koffron | |
| 4,610,436 A | | 9/1986 | LaBate, II et al. | |
| 4,634,106 A | | 1/1987 | LaBate, II | |
| 4,709,903 A | | 12/1987 | LaBate | |
| 4,799,650 A | | 1/1989 | Labate | |
| 4,871,148 A | | 10/1989 | Koffron | |
| 4,968,007 A | * | 11/1990 | Forte et al. | 266/230 |
| 5,044,610 A | | 9/1991 | Koffron | |
| 5,451,036 A | | 9/1995 | Eastwood | |
| 6,074,598 A | | 6/2000 | Koffron et al. | |

FOREIGN PATENT DOCUMENTS

| | | | |
|---|---|---|---|
| DE | 44 20 869 | | 12/1995 |
| DE | 19821981 A1 | | 8/1999 |
| EP | 0 834 367 | | 4/1998 |
| GB | 2 205 153 | | 11/1988 |
| JP | 2000-212627 | * | 2/2000 |
| WO | PCT/GB92/01757 | | 4/1993 |

* cited by examiner

*Primary Examiner*—Scott Kastler
(74) *Attorney, Agent, or Firm*—Brooks Kushman P.C.

(57) ABSTRACT

An improved vortex inhibitor for separating slag from molten metal during the discharge of molten metal through a nozzle includes a uniform castable refractory body with a generally tapering shape, a hollow chamber within the body and an elongated sacrificial member. The hollow chamber receives the sacrificial member or a mount for the sacrificial member. The refractory body and the sacrificial member combination in molten metal has a specific gravity less than the specific gravity of molten metal and is positioned narrow end downward when supported in molten metal. The hollow chamber can fill with molten metal to form a core that aids in orienting the body in a narrow end downward position. The sacrificial member align the with the area in which the vortex forms and minimizes interference with the flow through the discharge nozzle. The body preferably includes swirl obstructing surfaces.

8 Claims, 4 Drawing Sheets

Fig. 1
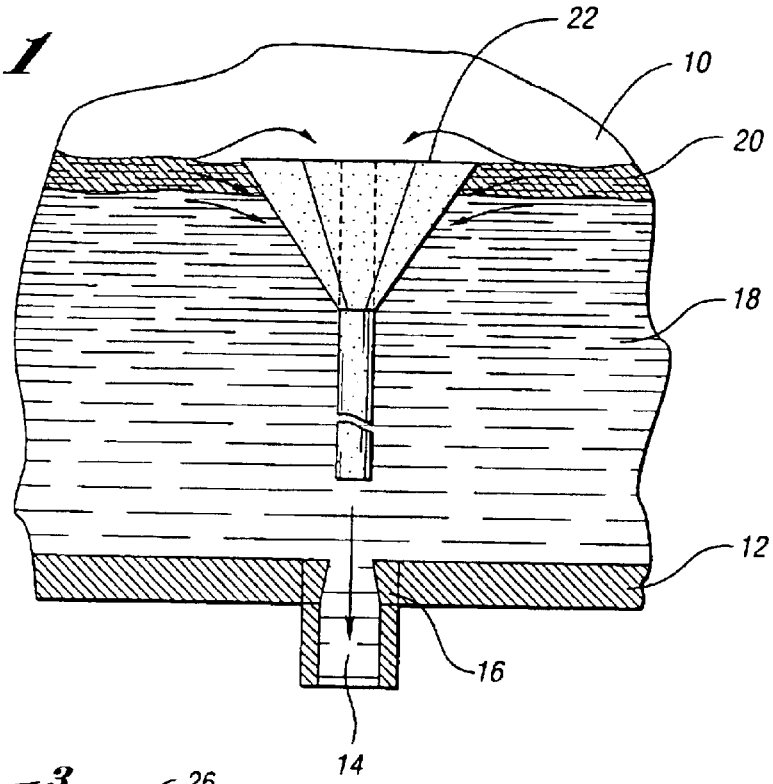
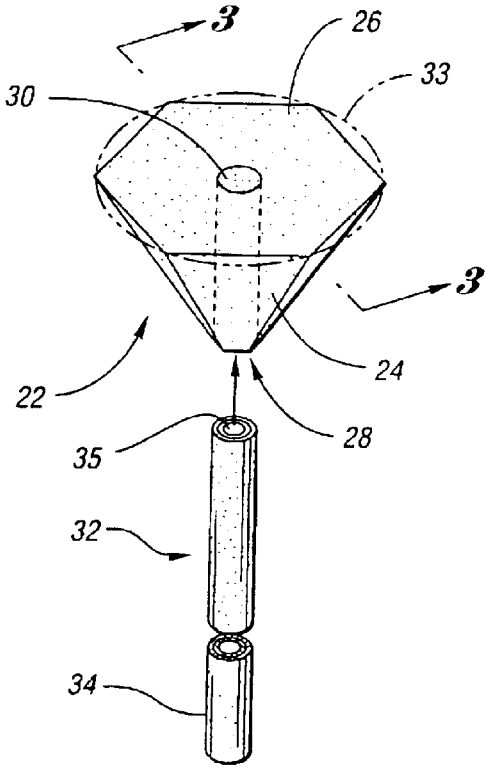
Fig. 2
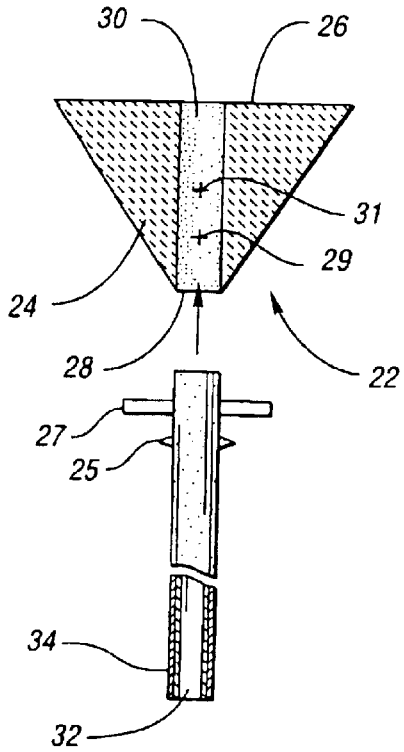
Fig. 3

VORTEX INHIBITOR WITH SACRIFICIAL ROD

FIELD OF THE INVENTION

The present invention relates to a device for separating slag from molten metal as the molten metal is transferred from a receptacle.

BACKGROUND ART

In metal making processes, a layer of slag comprising metal impurities forms atop the surface of molten metal held within a metal receptacle such as a furnace, tundish or ladle. As the molten metal is drained from the receptacle, the flow of molten metal through the discharge induces a swirl above the discharge nozzle. At a critical level, the energy of the swirl creates a vortex, whereby the slag layer is sucked into the nozzle, thus contaminating the pour. Separation of the slag and molten metal enhances the quality of the discharge.

Several devices have been known to inhibit the introduction of the slag into the nozzle via the sucking effect of the nozzle. Many of the previously known devices for restricting slag flow through the discharge nozzle were in the form of a refractory body and extending rod combination. For example, the abstract of German Disclosure DE 19821981 A1 to Stilkerieg discloses a slag retainer consisting of a closure body and a finned guide bar. The fin elements consist of a refractory material, preferably a refractory concrete. The closure body also has a bar protruding perpendicularly upwards from the base of the closure body. This bar is attachable to an arm which positions the slag retainer over the tapping channel. Although suitable for its intended purpose, the fin elements are expensive to fabricate. Therefore, the use of a finned guide bar substantially increases the costs of metal making. Moreover, the extending rod enters the tap hole and stifles the flow of molten metal through the nozzle during the pouring process. Consequently, metal pouring operation using this refractory body and extending rod combination extends processing time, and thus increases production costs.

U.S. Pat. No. 4,799,650 to LaBate discloses a slag retainer consisting of a tapered, circular refractory closure having a tapered, hexahedron-shaped refractory extension. The circular closure is sized sufficiently to close the tap hole. A metal rod is passed through the center of the circular closure and extends downwardly into the elongated hexahedron shaped extension to join the circular closure and the hexahedron-shaped extension. The hexahedron extension prematurely throttles the flow of molten metal through the discharge nozzle. Consequently, a significant amount of usable molten metal remains in the receptacle after the pour is stopped, substantially decreasing the total molten metal released per pour, and thus increasing operation costs.

U.S. Pat. No. 4,494,734 to LaBate et al. discloses a slag retainer with a modified cone-shaped refractory body and a rod. The rod extends below the center of the body and is covered with refractory sleeves. The upper extension contains a swivel mechanism which is used to engage a mechanical device that positions the slag retaining device over the tap hole. The patent also covers a method of minimizing slag carryover by dropping a body having a plurality of generally irregular faces and a guide means within a restricted area, draining a furnace, monitoring the stream for flaring, and shutting off flow through the tap hole. Unfortunately, continuous intrusion of the guide means extends the time for discharging metal and may encourage operators to prematurely terminate the flow of the molten metal. Additionally, the process of constructing and affixing refractory sleeves to the downward extension significantly increases the cost of manufacturing the slag retainer.

U.S. Pat. No. 4,709,903 to LaBate discloses a slag retainer consisting of a barrel shaped refractory body and a rod. The rod extends vertically through the barrel shaped body and upwardly and downwardly thereof. The upward extension is engaged to a mechanical device used to position the slag retaining device over the tap hole. The downward extension is covered with refractory sleeves. However, the downward extension enters the tap hole and continues to prematurely restrain the flow of molten metal through the discharge nozzle. Consequently, as previously discussed, the problem of premature termination of the pour results. The problems of shaping and assembling previously discussed are also encountered.

U.S. Pat. No. 4,610,436 to LaBate, II et al. discloses a slag retaining closure having a tapered body and an elongated guide means consisting of an elongated guide member and tip portion depending from the closure. A tip portion of the guide member having a recess or a cavity accelerates and aligns the guide member with the tap hole. The portion of the guide member extending below the tapered end of the closure is coated with refractory sleeves. As with the other disclosures, operation costs are increased due to premature throttling and pour termination. Moreover, the use of the intricate elongated guide means substantially increases manufacturing complexity and has been disfavored.

The previously known refractory body and extending rod combinations suffer from additional disadvantages. These combinations require pre-assembly. The resulting unit requires special packaging to ensure that the extending rod does not break off during delivery. Additionally, the cumbersome shape of the body and rod combination decreases the amount of units that can be shipped in any given space. Moreover, the elongated rods of existing devices may strike the wall of the receptacle instead of entering their intended position in the tap hole. Since the vortex forms above the tap hole, incorrectly positioned devices have little or no effect on inhibiting the vortex. The shipping and operational problems contribute to a lack of industry acceptance of vortex inhibitors with a body and rod combination.

SUMMARY OF THE INVENTION

The present invention overcomes the abovementioned disadvantages by providing a vortex inhibitor using a refractory body with a hollow chamber adapted to receive a sacrificial member. The vortex inhibitor has a specific gravity less than the specific gravity of molten metal and is self-orienting in a narrow end downward position in a molten metal bath. The sacrificial member does not inhibit the flow of the molten metal since it can dissipate shortly after introduction into the metal bath. Additionally, even if the sacrificial rod strikes the wall of the receptacle, the rod can dissipate shortly after introduction into the receptacle, thus freeing the body to relocate to the area in which the vortex forms. Furthermore, the sacrificial member may be constructed of inexpensive metal rod, bar, pole, or other types of elongated members such as tubes, rather than the intricate and expensive guide systems of the prior art.

In general, the vortex inhibitor of the present invention comprises a tapering, castable refractory body, a hollow chamber positioned longitudinally to the axis of tapering of the body, and an elongated sacrificial member carried by the hollow chamber. It is to be understood that the term castable refractory is a uniform mixture, but uniform does not require complete homogeneity of material and includes the intermixture of shot, steel fiber or other materials which may be consistently mixed with a castable refractory material to adjust the specific gravity of the body. In any event, the specific gravity of the uniform mixture is selected so that the body and sacrificial member combination is buoyantly supported at the interface of the slag layer and the molten metal layer. Moreover, the vortex inhibitor of the present invention does not require assembly before shipping, thus reducing the difficulty and cost associated with shipping previously known bodies with guides.

The body has a generally tapering shape along a longitudinal axis from a base toward a narrow end. The term generally tapering means that the body generally conforms with the shape of the vortex formed by the swirling molten metal above the discharge nozzle. The cross-sectional area of the base is greater than that of the narrow end. As used herein, the term narrow end is to be understood as not defining any particular shape, and may include a pointed end, a rounded end or a flat surface. The base can be formed from a simple or complex polygon, or a rounded or circular figure. Complex polygonal bases may include flats, recesses or notches. These features may extend lengthwise along the body. The taper is preferably consistent along the length of the body. The refractory body is preferably constructed by creating a mold of the generally tapering shape.

The hollow chamber is positioned longitudinally to the longitudinal axis of the body and extends within the body. The mold used to construct the refractory body has an insert, preferably in the form of a shaft which forms the hollow chamber during the curing process. Depending on the application, the shaft may be separated from the refractory body or retained within the refractory body once the molded mixture cures. If the shaft is separated from the refractory body, the resulting empty hollow chamber snugly receives the elongated sacrificial member. If the shaft is retained after construction, the sacrificial member is attached to an end of the shaft. In either event, when introduced into the molten metal receptacle, the hollow chamber may fill with molten metal that forms a core within the refractory body. The metal core helps orient the refractory body in a narrow end downward position.

The sacrificial elongated member may be constructed of hollow or solid metal and can be coated with a refractory material. If the elongated member is hollow, then the hollow can be filled with refractory material, as well. When the vortex inhibitor is placed in a molten metal receptacle, the sacrificial member can align the vortex inhibitor with the area in which the vortex would be likely to form. As the pouring process continues, the sacrificial member can dissolve into the molten metal bath, and thereby does not interfere with the flow of molten metal through the discharge nozzle.

Thus, the present invention provides a vortex inhibitor having a refractory body, a hollow chamber within the refractory body and a sacrificial member. These features help orient the refractory body so that its narrow end extends downwardly toward the discharge nozzle of a molten metal receptacle while not reducing the flow of molten metal through the discharge nozzle. When inserted into a molten metal bath, the resulting body and sacrificial member combination has a specific gravity less than the specific gravity of the molten metal. Preferably, the refractory body maintains a center of gravity closer to the narrow end than a center of buoyant support even when the rod has dissolved. Additionally, since the elongated member is sacrificial, it can dissolve before creating a throttling effect upon the discharge flow.

As a result, the present invention permits substantially complete drainage of the furnace with minimal intermixture of the slag and molten metal layers. Moreover, it will be understood that the present invention can also be used for other molten metal receptacles, such as ladles and tundishes, in which separation of the slag from molten metal must be maintained while the metal is discharged from the receptacle.

BRIEF DESCRIPTION OF DRAWINGS

The present invention will be more clearly understood by reference to the following detailed description of the embodiments of the present invention when read in conjunction with the accompanying drawings in which like reference characters refer to like parts throughout the views and in which:

FIG. 1 is an elevational view of a molten metal receptacle containing a vortex inhibitor constructed in accordance with the present invention;

FIG. 2 is a perspective view of the vortex inhibitor shown in FIG. 1;

FIG. 3 is a sectional view taken substantially along the line 3—3 in FIG. 2;

DETAILED DESCRIPTION OF A PREFERRED EMBODIMENT

Figure 4:
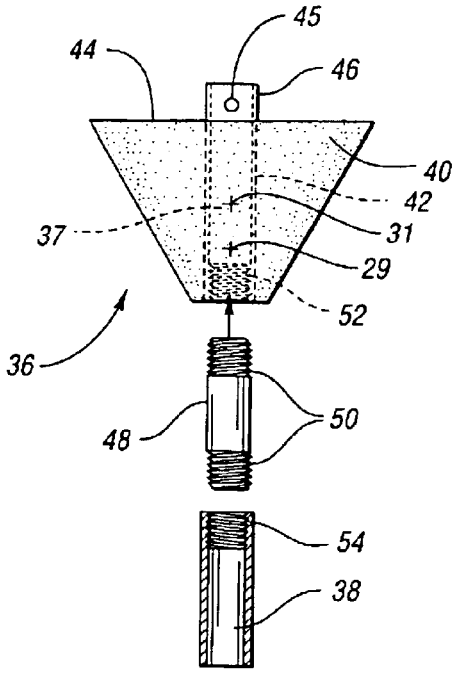
FIG. 4 is a sectional view of an embodiment of a vortex inhibitor constructed in accordance with the present invention.

Referring first to FIG. 1, a molten metal receptacle 10 is shown having a bottom wall 12 with a discharge nozzle 14 and nozzle opening 16. The molten metal receptacle 10 can be a furnace, ladle, reservoir, tundish or other receptacle from which molten metal is discharged through a nozzle 14. Regardless of the type of receptacle, the receptacle 10 is shown containing a layer of molten metal 18. A layer of slag 20, having a specific gravity less than the specific gravity of the molten metal 18, rests on top of the layer of molten metal 18. A vortex inhibitor 22 according to the present invention is shown supported at the interface of the slag layer 20 and the molten metal layer 18 within the receptacle 10.

Referring now to FIGS. 2 and 3, the vortex inhibitor 22 comprises a body 24 having a base 26 and narrow end 28, a hollow chamber 30 and an elongated sacrificial member 32. As depicted by the upward arrows in FIGS. 2 and 3, the sacrificial member 32 slides into the hollow chamber 30 to form an integral vortex inhibitor. Alternatively, the refractory body 24 can be molded around the sacrificial member 32. The sacrificial member 32 may be modified with crimps 25 or protrusions 27, which mount the sacrificial member 32 in the hollow chamber 30 once the refractory body 24 cures.

The outermost points of the base intersect a circle 33 circumscribed about the base. The diameter of the circle 33 is larger than the diameter of the nozzle opening 16 so that only a portion of the body may become lodged within the nozzle. Due to the harsh environmental conditions within the furnace, the diameter of the circle may be substantially larger than the diameter of the nozzle opening 16 so that erosion of the body does not reduce the maximum diameter of the outermost points of the base to less than the diameter of the nozzle opening.

The body 24 generally tapers downwardly from the base 26 towards the narrow end 28. The resulting generally tapering shape is substantially regular so that cross-sectional shapes sliced downwardly from and perpendicularly to the base 26 towards the narrow end 28 are substantially congruent. However, some variation in the cross-sectional shapes can be accommodated.

When the body 24 and the sacrificial member 32 combination is supported at the interface of the slag layer 20 and the molten metal layer 18, the combination is self-orienting in a narrow end downward position. In the present embodiment, this orientation can be aided by the hollow chamber 30 and the sacrificial member 32. Specifically, after the vortex inhibitor 22 is dropped into the molten metal receptacle 10, the hollow chamber 30 can fill with molten metal that forms a core. The core acts to stabilize the position of the vortex inhibitor 22 in the molten metal so that the narrow end 28 points downwardly when the vortex inhibitor floats at the slag-metal interface. Additionally, the sacrificial member 32 may enter the discharge nozzle 14 for a limited time before dissipating. During this initial period before dissipation, the sacrificial member steadies the vortex inhibitor 22 in a narrow end 28 downward position. Moreover, the sacrificial member 32 can initially align the vortex inhibitor 22 with the area in which the vortex would be likely to form. Even if the sacrificial rod dissolves, the refractory body maintains a center of gravity 29 closer to the narrow end than a center of buoyant support 31.

The sacrificial member 32 is preferably a metal pipe, rod or bar. The length and width of the sacrificial member can be varied greatly as long as the resulting vortex inhibitor construction has a specific gravity less than the specific gravity of the molten metal and is self-orienting in a narrow end downward position when supported in molten metal. A refractory coating 34 is optionally attached to the surface of the sacrificial member 32. If the sacrificial member is hollow, a refractory coating or core 35 may be included within the hollow sacrificial member. Depending on the operating conditions of the molten metal receptacle, an interior or exterior refractory coating may prolong the life of the sacrificial rod 32. The sacrificial nature of the elongated member does not impinge on the flow of molten metal through the discharge nozzle 14.

Referring now to FIG. 4, the vortex inhibitor 36 is shown with modifications 37 to the hollow chamber 30 and modifications of the system of attaching the elongated sacrificial member 38 to the refractory body 40. In the embodiment shown, a hollow shaft 42 is snugly positioned in the hollow chamber 30, for example, by using the sleeve as the mold insert during pouring of the refractory material. The shaft 42 extends beyond the base 44 of the vortex inhibitor 36. The exposed portion 46 of the hollow shaft 42 contains a notch 45 adaptable for receiving a locating arm (not shown). The locating arm is responsible for positioning the vortex inhibitor 36 over the area in which the vortex would be likely to form and selectively dropping the vortex inhibitor into the molten metal receptacle. In the embodiment shown, the sacrificial member 38 is attached to the hollow shaft 42 by the use of a nipple 48, which contains external screw threads 50 on both ends. The nipple 48 mates with the hollow shaft 42, which has internal screw threads 52, and mates with an end of the sacrificial member 38, which contains internal screw threads 54.

Figure 5:
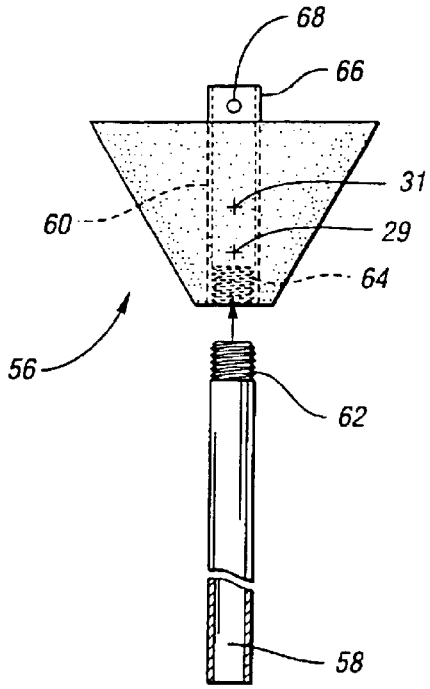
FIG. 5 is a sectional view of a further embodiment of a vortex inhibitor constructed in accordance with the present invention.

Referring now to FIG. 5, the vortex inhibitor 56 is shown with a further modification to the system of attaching the sacrificial member 58 to the hollow shaft 60. The sacrificial member 58 connects to the hollow shaft 60 through screw threading although other connectors may also be used. External screw threads 62 contained on an end of the sacrificial elongated member mates with internal screw threads 64 on the hollow shaft 60. As with the embodiment shown in FIG. 4, the hollow shaft 60 has an exposed portion 66 which may contain a notch 68 for receiving a locating arm (not shown).

Figure 6:
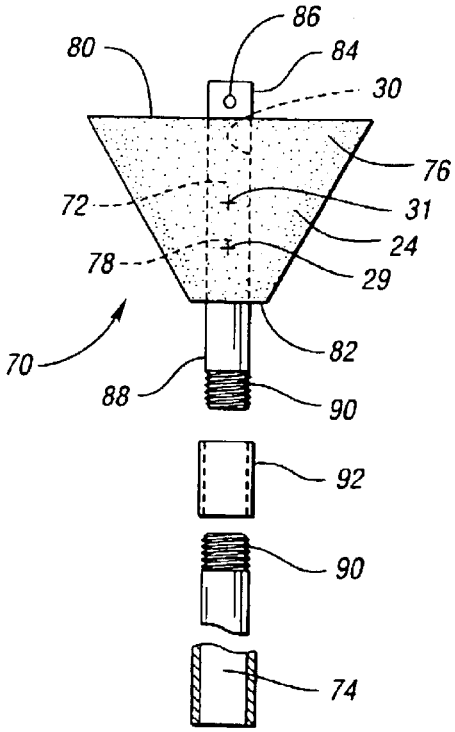
FIG. 6 is a sectional view of yet another embodiment of a vortex inhibitor constructed in accordance with the present invention.

Referring now to FIG. 6, the vortex inhibitor 70 is shown with modifications 72 to the hollow chamber 30 and modifications as shown at 74 and 76 to the system of attaching the elongated sacrificial member to the refractory body. In the embodiment shown, a solid shaft 78 is snugly positioned in the hollow chamber 30 and extends beyond the base 80 and narrow end 82 of the vortex inhibitor 70. The portion 84 extending beyond the base 82 of solid shaft 78 contains a bore 86 adaptable for receiving a locating arm (not shown). The locating arm is responsible for positioning the vortex inhibitor 70 over the area in which the vortex would be likely to form and selectively dropping the vortex inhibitor into the molten metal receptacle. In the embodiment shown, the portion 88 extending beyond the narrow end 82 of solid shaft 78 contains external screw threads 91. Likewise, an end of sacrificial member 74 contains external screw threads 90, although other connectors may be used. A coupling 92 mates the solid shaft 78, which has external screw threads 91, with the end of the sacrificial member 74 containing external screw threads 90, thus forming an integral refractory body and sacrificial member combination.

Figure 7:
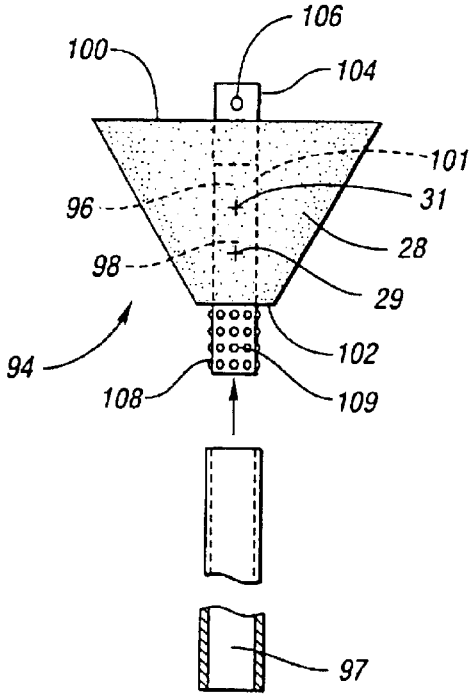
FIG. 7 is a sectional view of a further embodiment of a vortex inhibitor constructed in accordance with the present invention.

Referring now to FIG. 7, the vortex inhibitor 94 is shown with further modifications 96 to the hollow chamber 30 and modifications 97 to the system of attaching the elongated sacrificial member to the refractory body. In the embodiment shown, a solid shaft 98 is snugly positioned in the hollow chamber 30 and extends both beyond the base 100 and the narrow end 102 of the vortex inhibitor 94. Alternatively, the solid shaft 98 may only extend beyond the narrow end 102 of the vortex inhibitor 94, thus forming a bolt 101. The portion 104 extending beyond the base 100 of solid shaft 98 contains a bore 106 adaptable for receiving a locating arm (not shown). If the bolt 101 is utilized, the base 100 can be fitted with a hook (not shown) adaptable for receiving the locating arm (not shown). The locating arm is responsible for positioning the vortex inhibitor 94 over the area in which the vortex would be likely to form and selectively dropping the vortex inhibitor into the molten metal receptacle.

In the embodiment shown, the portion 108 of solid shaft 98 or bolt 101 extending beyond the narrow end 102 is of suitable diameter to snugly receive the hollow sacrificial member 97. This snug fit may be achieved by varying the diameter of the extending portion 108 or creating gripping surface features, for example protrusions 109, on the surface of the extending portion 108. However the snug fit is accomplished, the result is an integral refractory body and sacrificial rod combination.

Regardless of the method by which the sacrificial member is joined with the shaft, the specific gravity of the vortex inhibitor supports it at the interface of the slag layer 20 and the molten metal 18. Further, regardless of the joining method, the outside surface of the sacrificial member may be coated with refractory material. Additionally, the inside surface of a hollow sacrificial member may be coated with refractory material.

Figure 8:
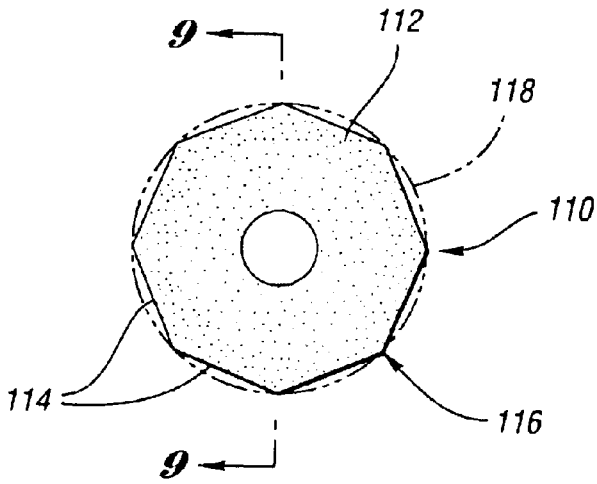
FIG. 8 is a top plan view of a modified refractory body constructed in accordance with the present invention.
Figure 9:
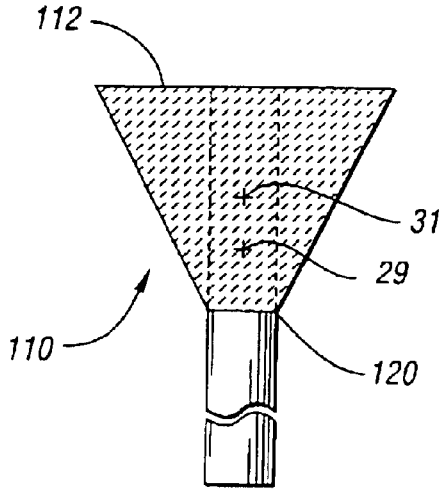
FIG. 9 is a sectional view taken substantially along the line 9—9 in FIG. 8.

Referring now to FIGS. 8 and 9, the vortex inhibitor is shown with a modified body 110 having an octagonal base 112 and flat sides 114. As with the embodiment shown in FIG. 2, the vertices 116 of the octagonal base intersect a circle 118 circumscribed about the base and having a diameter dimensioned to exceed the diameter of the nozzle opening 14. In addition, the body 110 tapers downwardly toward a narrow end 120 in a substantially regular manner.

Figure 10:
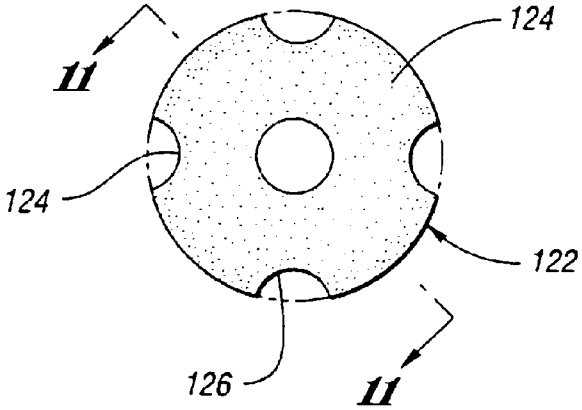
FIG. 10 is a top plan view of another modified refractory body constructed in accordance with the present invention.
Figure 11:
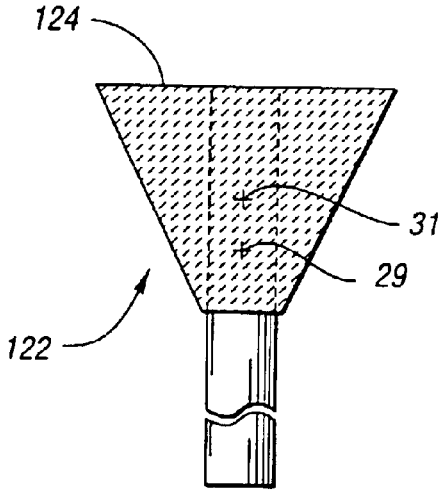
FIG. 11 is a sectional view taken substantially along the line 11—11 in FIG. 10.

FIGS. 10 and 11 show a further modification of a generally tapering body 122 of vortex inhibitor. As shown in the drawings, a body 122 has a substantially circular base 124. However, unlike the flat sides of the bodies 24 and 110 shown in FIGS. 2 and 8 respectively, surfaces for enhancing fluid contact that inhibiting the vortex are formed by recesses 126 extending along the sides of the refractory body 122.

Figure 12:
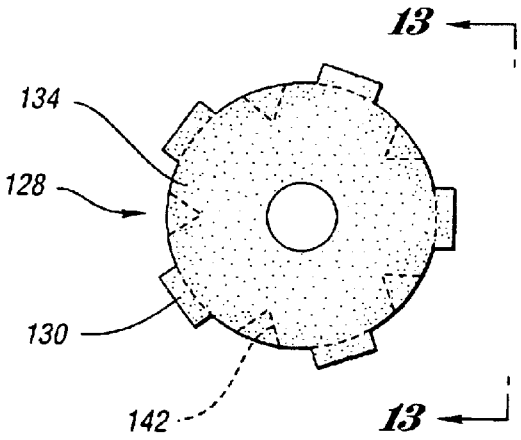
FIG. 12 is a top plan view of a further modification of a refractory body constructed in accordance with the present invention.
Figure 13:
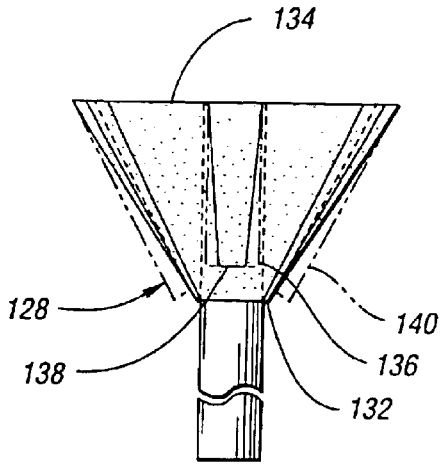
FIG. 13 is a sectional view taken substantially along the line 13—13 in FIG. 12.

The embodiment as shown in FIGS. 12 and 13 is similar to FIG. 10 but vortex inhibiting is enhanced by projections extending outwardly from the periphery of a substantially conical body 128. Like the recesses 126 shown in the body 122, a projection 130 can be tapered from the base 134 toward the narrow end 132, preferably tapering. Alternatively, like the recesses 126 in the body 122, the projections 130 extends from the base 134 to the narrow end 132 as shown in phantom line at 136. Moreover, while the recesses 126 or the projections 130 are most effective when extending along the entire length from the base to the narrow end, it may be understood that such projections and recesses may be truncated short of the entire length of the body as shown in phantom line at 138. Variations in the width and the depth of the projections or recesses are also possible, as indicated by the constant height projections illustrated in phantom line at 140 in FIG. 13. In addition, a combination of vortex inhibiting surfaces, for example, a combination of recesses and projections, can also be employed as desired without departing from the scope of the present invention. As a further example, flat sided recesses 142 are shown in phantom line at 142 in FIG. 12.

Figure 14:
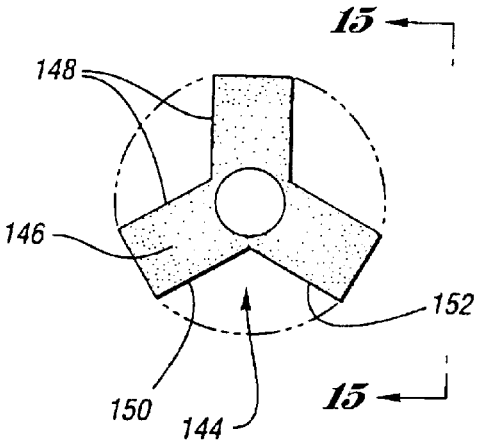
FIG. 14 is a top plan view of another modified refractory body constructed in accordance with the present invention.
Figure 15:
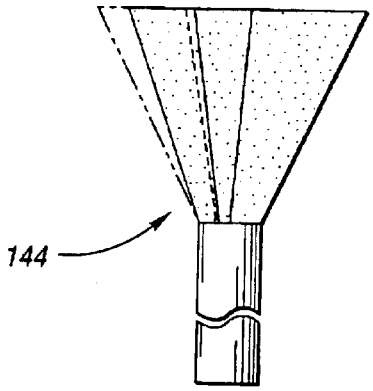
FIG. 15 is a sectional view taken substantially along the line 15—15 in FIG. 14.

While the previously described embodiments have a base with a simple geometrical shape, it is also to be understood that complex geometrical shapes can also be employed in producing the vortex inhibitor according to the present invention. FIGS. 14 and 15 disclose a refractory body 144 having a complex polygonal base 146. In particular, the base 146 combines a plurality of simple polygonal shapes emanating outwardly from the center of the body 144. The intersection of the rectangular polygons 148 form planar surfaces 150 and 152 which intersect in a "V" and inhibit vortex action, while the depth of the V-shaped recesses control the throttling effect once the body penetrates the nozzle opening 14.

Figure 16:
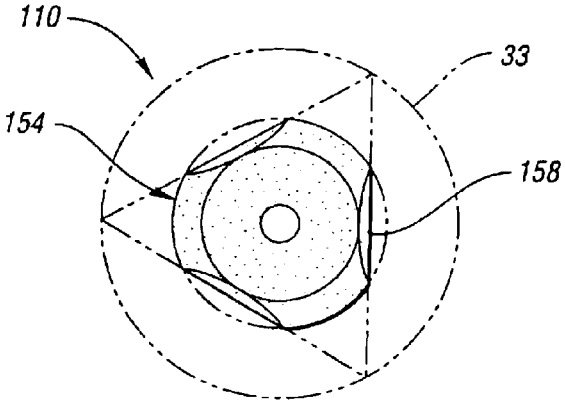
FIG. 16 is a top plan view of yet another modified refractory body constructed in accordance with the present invention.
Figure 17:
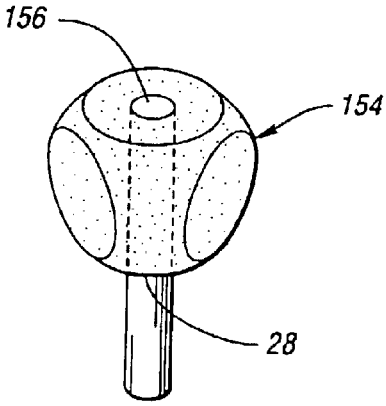
FIG. 17 is a perspective view of the body shown in FIG. 16.

As shown in FIGS. 16 and 17, a substantially spherical body 154 can be modified to include vortex inhibiting surfaces by cutting regular recesses in the spherical structure. The modification shown in FIGS. 16 and 17 is formed by truncating the sphere at the intersections of a regular tetrahedron and the sphere, although other truncations or protrusions may be added. The flat sides 156 taper downwardly toward the apex 28.

All of the previously described modifications to the shape of the refractory body have common characteristics. All of the shapes provide inertia against the swirling motion of molten metal above the discharge nozzle 14. Additionally, the shape of the refractory body inhibits the formation of vortex suction, a phenomena responsible for drawing slag impurities into the molten metal poured through the nozzle. Nevertheless, the sacrificial rod adds additional control and stability without inhibiting the discharge of molten metal. It is also understood that any of the previously described refractory body shapes may be combined with any of the previously described mounts or methods of joining the sacrificial member with the refractory body in order to form an integral refractory body and sacrificial rod combination.

Having thus described the present invention, many modifications thereto will become apparent to those skilled in the art to which it pertains without departing from the scope and spirit of the present invention as defined in the appended claims.

What is claimed is:

1. A method for improving yield of molten metal poured from a discharge nozzle of a metal pouring vessel, the method comprising:

introducing a vortex inhibitor having a uniform castable refractory body having a generally tapering shape along a longitudinal axis from a base toward a narrow end and a hollow chamber longitudinally to the body extending within the body and an elongate sacrificial member retained by the hollow chamber to form an integral body, whereby the integral body combining the refractory body and the sacrificial member has a specific gravity less than the specific gravity of molten metal, and is self-orienting in a narrow end downward position when supported in molten metal; and maintaining the vortex inhibitor in the metal pouring vessel during at least a portion of the metal pour, while dissolving the elongated sacrificial member before substantially obstructing the discharge nozzle.

2. The method of claim 1 wherein said dissolving step occurs before discharge of molten metal is terminated.

3. The method of claim 1 wherein said dissolving step occurs before the discharge nozzle is closed.

4. The method of claim 1 wherein said dissolving step occurs before entering the discharge nozzle.

5. A method for improving yield of molten metal poured from a discharge nozzle of a metal pouring vessel, the method comprising:

introducing a tapering uniform castable refractory body having a hollow chamber positioned longitudinally to the body extending within the body and an elongated sacrificial member retained by the hollow chamber to form an integral body, whereby the integral body combining the refractory body and the sacrificial member has a specific gravity less than the specific gravity of molten metal, and is self-orienting in an elongated sacrificial member downward position when supported in molten metal; and maintaining the tapering uniform castable refractory body in the metal pouring vessel during at least a portion of the metal pour, while dissolving the elongated sacrificial member before substantially obstructing the discharged nozzle.

6. The method of claim 5 wherein said dissolving step occurs before discharge of molten metal is terminated.

7. The method of claim 5 wherein said dissolving step occurs before the discharge nozzle is closed.

8. The method of claim 5 wherein said dissolving step occurs before entering the discharge nozzle.

* * * * *